US009501956B2

(12) United States Patent
Fluharty

(10) Patent No.: US 9,501,956 B2
(45) Date of Patent: Nov. 22, 2016

(54) COMBINATION GREETING CARD AND GIFT CARD PRESENTER

(71) Applicant: HALLMARK CARDS, INCORPORATED, Kansas City, MO (US)

(72) Inventor: Charity Robin Fluharty, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 15/136,609

(22) Filed: Apr. 22, 2016

(65) Prior Publication Data

US 2016/0240109 A1 Aug. 18, 2016

Related U.S. Application Data

(62) Division of application No. 14/669,880, filed on Mar. 26, 2015, now abandoned.

(60) Provisional application No. 61/971,414, filed on Mar. 27, 2014.

(51) Int. Cl.
*G09F 1/10* (2006.01)
*B42D 15/04* (2006.01)
(Continued)

(52) U.S. Cl.
CPC ..... *G09F 1/10* (2013.01); *B42D 15/042* (2013.01); *B42D 15/045* (2013.01); *B42D 15/085* (2013.01); *B42D 25/285* (2014.10); *B65D 5/5286* (2013.01); *G09F 1/04* (2013.01)

(58) Field of Classification Search
CPC ..... B42D 25/00; G06K 19/041
See application file for complete search history.

(56) References Cited

U.S. PATENT DOCUMENTS 3,104,800 A * 9/1963 Johnson et al. ..... B42D 15/08 229/70
3,759,372 A * 9/1973 Venema ..... B65D 69/00 206/472

(Continued)

FOREIGN PATENT DOCUMENTS

EP 220827 A1 5/1987
JP 2013107309 A * 6/2013

OTHER PUBLICATIONS

International Search Report with Written Opinion dated Jul. 6, 2015 in Application No. PCT/US2015/023025, 10 pages.

(Continued)

*Primary Examiner* — Cassandra Davis
(74) *Attorney, Agent, or Firm* — Shook, Hardy & Bacon L.L.P.

(57) ABSTRACT

The present invention relates to a combination greeting card and gift card presenter. In one aspect, the presenter comprises a cover panel and a gift card panel, the gift card panel including a magnetic strip for storing machine readable information, the cover panel and the gift card panel coupled together along a fold line. In another aspect, multiple intermediary panels are coupled between the cover panel and the gift card panel to allow for one sided custom printing. The cover panel may also be coupled to a gift card holder that comprises a first fold panel and a second fold panel folded together to form a pocket for receiving at least a portion of a gift card. The cover panel and the first or second fold panel may be coupled along an edge, and the fold panels may include tabs for securing the first and second fold panels together.

17 Claims, 7 Drawing Sheets

(51) Int. Cl.

| | |
|---|---|
| ***B65D 5/52*** | (2006.01) |
| ***B42D 15/08*** | (2006.01) |
| ***B42D 25/20*** | (2014.01) |
| ***G09F 1/04*** | (2006.01) |

(56) References Cited

U.S. PATENT DOCUMENTS

| | | | | | |
|---|---|---|---|---|---|
| D258,452 | S | | 3/1981 | Hewitt | |
| 4,632,428 | A | | 12/1986 | Brown | |
| 4,636,179 | A | | 1/1987 | Gentile et al. | |
| 5,096,058 | A | | 3/1992 | Juravin et al. | |
| 5,119,933 | A | * | 6/1992 | Taylor | G11B 33/0494 206/232 |
| 5,197,663 | A | * | 3/1993 | Stude | B65D 27/06 229/301 |
| 5,267,687 | A | * | 12/1993 | Sherman | B65D 27/06 229/305 |
| 5,503,434 | A | | 4/1996 | Gunn | |
| 5,645,214 | A | * | 7/1997 | Taganas | B65D 27/34 229/313 |
| 5,836,507 | A | * | 11/1998 | Mueller | B42F 7/02 229/67.1 |
| 5,862,979 | A | | 1/1999 | Hill et al. | |
| 5,931,293 | A | * | 8/1999 | Seelenmeyer | B65D 85/546 206/308.1 |
| 5,946,834 | A | | 9/1999 | Bradley | |
| 5,988,685 | A | * | 11/1999 | Mogelonsky | B42F 7/02 229/71 |
| 6,006,988 | A | | 12/1999 | Behrmann et al. | |
| 6,082,612 | A | | 7/2000 | Black et al. | |
| 6,192,661 | B1 | * | 2/2001 | Bodart | B31B 41/00 414/412 |
| 6,824,066 | B2 | | 11/2004 | Weyant | |
| 6,877,263 | B2 | | 4/2005 | Clark | |
| 6,966,135 | B1 | | 11/2005 | McDonald | |
| 7,024,807 | B2 | | 4/2006 | Street | |
| 7,204,048 | B2 | | 4/2007 | Kershner et al. | |
| 7,219,829 | B2 | * | 5/2007 | Treat | B42D 15/042 229/71 |
| 7,222,446 | B2 | | 5/2007 | Foster | |
| 8,650,779 | B1 | | 2/2014 | Glass et al. | |
| 8,707,594 | B2 | | 4/2014 | Glass et al. | |
| 2002/0100797 | A1 | | 8/2002 | Hollingsworth et al. | |
| 2004/0149603 | A1 | * | 8/2004 | Hodsdon | G11B 33/0416 206/312 |
| 2005/0247798 | A1 | | 11/2005 | Graves et al. | |
| 2006/0231609 | A1 | | 10/2006 | Lazarowicz et al. | |
| 2006/0255162 | A1 | | 11/2006 | Nicholas | |
| 2007/0152066 | A1 | | 7/2007 | Colby et al. | |
| 2007/0251995 | A1 | | 11/2007 | Kingsborough et al. | |
| 2008/0047173 | A1 | | 2/2008 | Wilen | |
| 2008/0116088 | A1 | | 5/2008 | Roberts | |
| 2012/0260542 | A1 | | 10/2012 | Kibbe et al. | |
| 2013/0213833 | A1 | | 8/2013 | Pruett | |
| 2014/0076975 | A1 | | 3/2014 | Bellmyer et al. | |

OTHER PUBLICATIONS

International Search Report with Written Opinion dated Aug. 14, 2015 in Application No. PCT/US2015/023022, 10 pages.

Non-Final Office Action dated Oct. 19, 2015 in U.S. Appl. No. 14/669,862, 10 pages.

Office Action dated Jan. 22, 2016 in U.S. Appl. No. 14/669,880, 14 pages.

* cited by examiner

COMBINATION GREETING CARD AND GIFT CARD PRESENTER

CROSS-REFERENCE TO RELATED APPLICATIONS

This application is a divisional application of U.S. patent application Ser. No. 14/669,880 ("COMBINATION GREETING CARD AND GIFT CARD PRESENTER"), filed Mar. 26, 2015, which claims the benefit of U.S. Provisional Application No. 61/971,414 ("GIFT CARD PRESENTER FOR GREETING CARDS"), filed Mar. 27, 2014. The teachings of each of these referenced applications are incorporated herein by reference in their entirety.

STATEMENT REGARDING FEDERALLY SPONSORED RESEARCH OR DEVELOPMENT

Not applicable.

TECHNICAL FIELD

The present invention generally relates to the giving of gift cards. More specifically, the present invention relates to a number of different embodiments of a combination greeting card and gift card presenter.

BACKGROUND

Over the past several years, as our society has gotten more and more active, people have looked for easier and more convenient ways to handle regular tasks. One of these regular tasks is the giving of gifts. Today's consumers are more often giving gift cards in place of actually purchasing a present for someone, for convenience purposes. However, many consumers have expressed guilt for simply giving a gift card, rather than purchasing an actual gift for someone. Some consumers would like to present a gift card to a recipient in a more attractive and personal manner than simply enclosing it in a standard greeting card or envelope. A combination greeting card and gift card with integrated aspects is needed to allow a gift giver to give a gift card in an attractive manner.

SUMMARY

This summary is provided to introduce a selection of concepts in a simplified form that are further described below in the detailed description section. This summary is not intended to identify key or essential features of the claimed subject matter, nor is it intended to be used as an aid in determining the scope of the claimed subject matter. The scope of the invention is defined by the claims.

Embodiments of the present invention are directed to a combination greeting card and gift card presenter. In a broad aspect, one embodiment of the presenter comprises a cover panel and a gift card panel, the gift card panel including a magnetic strip having machine readable information, the cover panel and the gift card panel being coupled together. The cover panel and the gift card panel may be the same or different sizes (e.g., each the size of a standard gift card), and may be directly coupled along a fold line such that the cover panel and the gift card panel may be folded together into a compact arrangement where the cover panel conceals the gift card. The magnetic strip may be on either side of the gift card panel such that it is revealed or concealed when the panels are folded together. The cover panel and the gift card panel may be made of the same materials, such as die-cut card stock, apart from the magnetic strip, which may printed, affixed, integrated, or otherwise placed on the gift card panel.

In one exemplary embodiment, the presenter may be formed from die-cut card stock and include four panels separated by fold lines. The panels may comprise a cover panel, a first intermediary panel coupled to the cover panel along a first fold line, a second intermediary panel coupled to the first intermediary panel along a second fold line, and a gift card panel coupled to the second intermediary panel along a third fold line. The magnetic strip may be printed, affixed, or secured to a side of the gift card panel. A printed image or display may be printed on one or both sides of the presenter, such that when the panels are folded together to form the compact arrangement, with the cover panel on one side and the greeting card panel on the opposite side, and the presenter can be opened like a traditional greeting card to reveal an interior having sentiment, an image and/or a design.

In another aspect, an alternate embodiment of the presenter comprises a cover panel and a gift card holder, the cover panel and the gift card holder are coupled together. The gift card holder comprises a first fold panel and a second fold panel folded together to form a pocket for receiving at least a portion of a gift card. One or more intermediary panels may again be integrated between the cover panel and the fold panels, and the connections therebetween may be the same as in the aspect described above. The gift card holder may be formed to include a first fold line separating the first fold panel and the second fold panel. The first fold panel and the second fold panel may be folded together and secured to form the pocket. The first and/or the second fold panels may include tabs on outer edges of the first and/or the second fold panels with a face of the tabs configured to be secured or affixed (e.g., with adhesive, double-sided tape, or the like) to the opposite fold panel. In this regard, the first fold panel, the second fold panel, and the tab portions may define the pocket. Portions of the fold panels may be cut-out to allow a portion of the gift card to be revealed when the gift card is placed in the pocket.

BRIEF DESCRIPTION OF THE SEVERAL VIEWS OF THE DRAWINGS

The present invention is explained in more detail with reference to the embodiments illustrated in the attached drawing figures, in which like reference numerals denote like elements, wherein.

DETAILED DESCRIPTION

The present invention, in its simplest terms, may be referred to as a "combination greeting card and gift card presenter." The presenter is designed to combine a folded greeting card and a gift card to present the gift card in an attractive and personal manner. Various embodiments of the presenter are described below.

FIGS. 1-5 depict a first embodiment of the combination greeting card and gift card presenter. Generally, in the first embodiment, the presenter comprises a cover panel, a first intermediary panel, a second intermediary panel, and a gift card panel including a magnetic strip with machine readable information. Alternate embodiments are contemplated, with more or fewer panels, different fold lines, different securement mechanisms or couplings, and different positioning of the gift card. The embodiments are not limited to those described in the figures.

Figure 1:
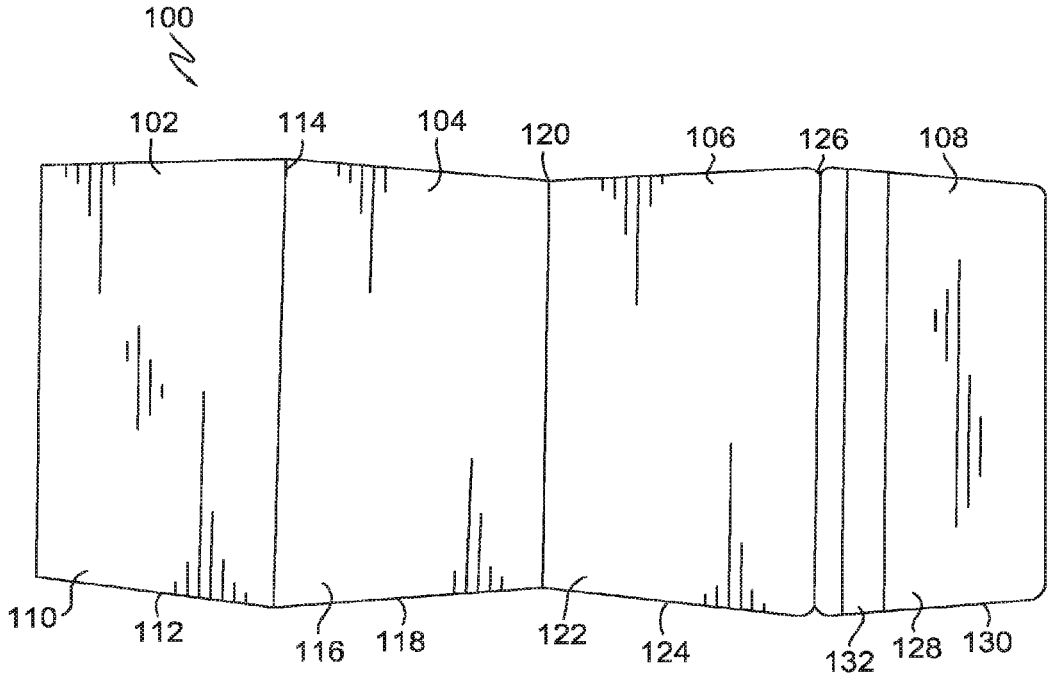
FIG. 1 depicts a front perspective view of a first embodiment of a combination greeting card and gift card presenter, in accordance with an aspect of the present invention.

Referring now to FIG. 1, a front perspective view of a first embodiment of a combination greeting card and gift card presenter 100 is depicted, in accordance with an aspect of the present invention. The first embodiment of the presenter 100 is formed from a single piece of card stock that is die cut and folded to provide four panels, namely, a cover panel 102, a first intermediary panel 104, a second intermediary panel 106, and a gift card panel 108. It should be noted that the term "die cut" should be interpreted broadly to cover all types of cutting the shape out of a piece of material or stock (e.g. laser, scissors, etc.). Similarly, while "card stock" is identified in the described example, the invention is not so limited. The phrase "card stock" should be interpreted broadly to cover other types of material, such as plastics, synthetic paper, etc.

Figure 3:
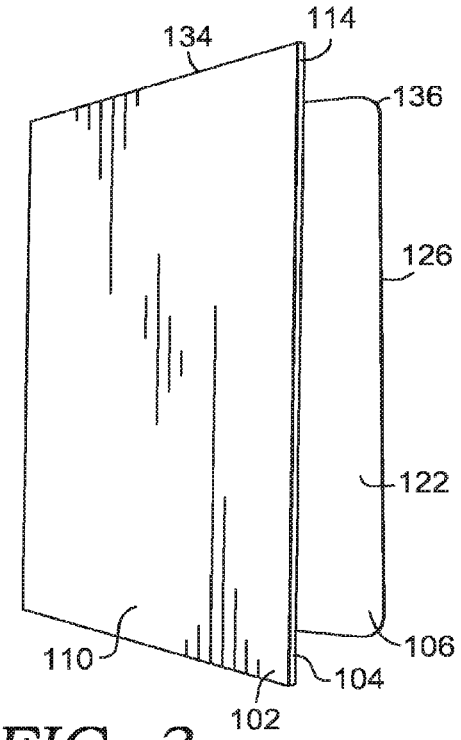
FIG. 3 depicts a front perspective view of the presenter depicted in FIG. 1, the presenter in a fully formed use arrangement and in a semi-closed configuration.
Figure 4:
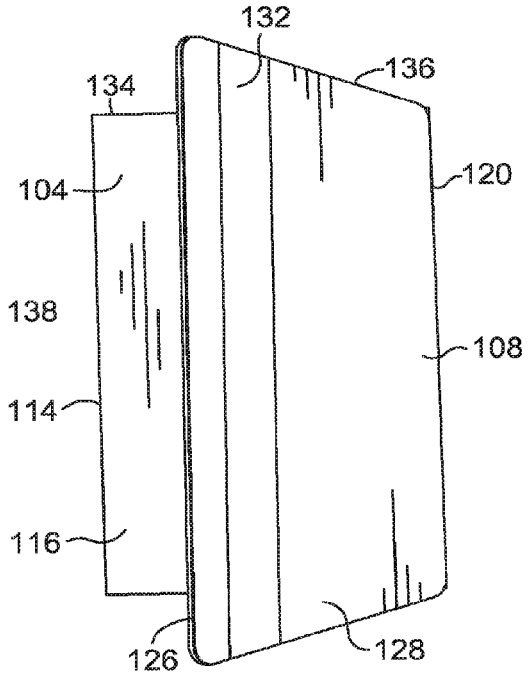
FIG. 4 depicts a rear perspective view of the presenter depicted in FIG. 3.
Figure 5:
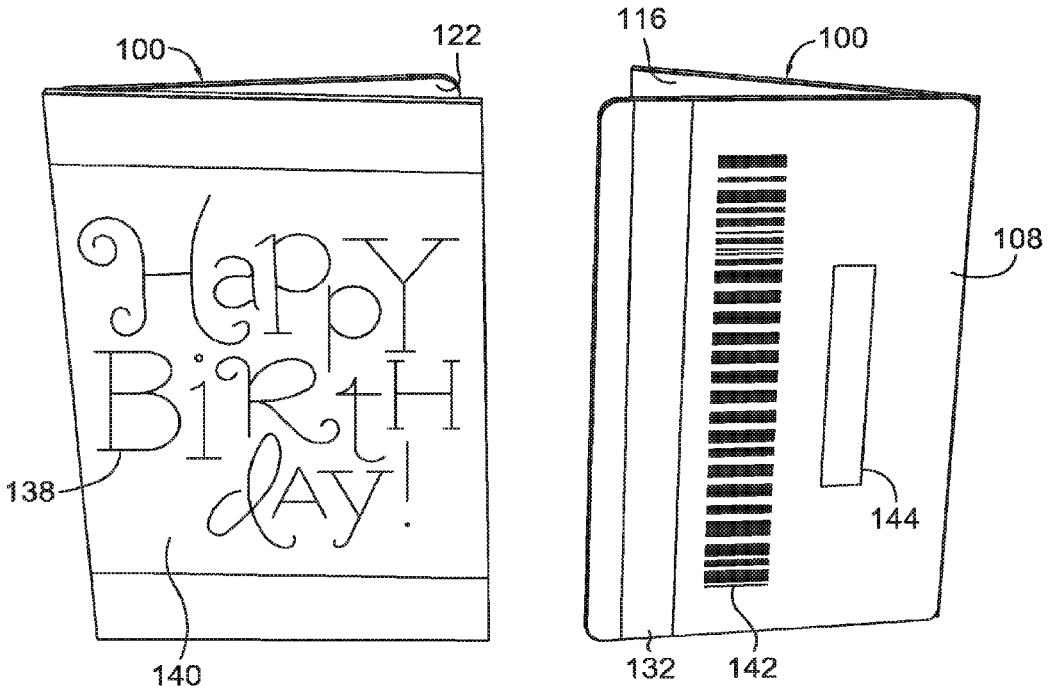
FIG. 5 depicts front and rear perspective views of the presenter of FIGS. 3-4 with indicia printed thereon and ready for use.

The cover panel 102 has a first side 110 and a second side 112 and is coupled to the first intermediary panel 104 along a first fold line 114. It should be noted that the term "fold line" as used herein should be interpreted broadly to cover all types of bends, scores, rules, creases, perforations, etc. The first intermediary panel 104 has a first side 116 and a second side 118 and is coupled to the second intermediary 106 panel along a second fold line 120. The second intermediary panel 106 has a first side 122 and a second side 124 and is coupled to the gift card panel 108 along a third fold line 126. The gift card panel 108 has a first side 128 and a second side 130. A magnetic strip 132 capable of containing machine readable information (e.g., relating to the value of the gift card) is provided on the first side 128 of the gift card panel 108. It should be noted that while a magnetic strip is discussed in connection with the illustrated embodiment, other manners of providing machine readable information (e.g., bar codes, QR codes, etc.) are within the scope of the present invention and may be used in place of the magnetic strip. The panels 102, 104, 106, 108 may be folded together such that they are in a stacked arrangement, with the first side 110 of the cover panel 102 positioned as a first front outside surface of the presenter 100 and the first side 128 of the gift card panel 108 positioned as a second rear outside surface of the of the presenter 100. Additionally, in this stacked arrangement, the second side 112 of the cover panel 102 and the second side 118 of the first intermediary panel 102 are facing each other and are preferable coupled together (e.g., by adhesive) in an abutting relationship. Further, in this stacked arrangement, which is illustrated in FIGS. 3-5, the first side 116 of the first intermediary panel 104 and the first side 122 of the second intermediary panel 106 may be facing each other and the second side 124 of the second intermediary panel 106 and the second side 130 of the gift card panel 108 are facing each other and are preferable coupled together (e.g., by adhesive) in an abutting relationship. This arrangement presents the appearance of a standard two panel greeting card that can be opened and closed.

Figure 2:
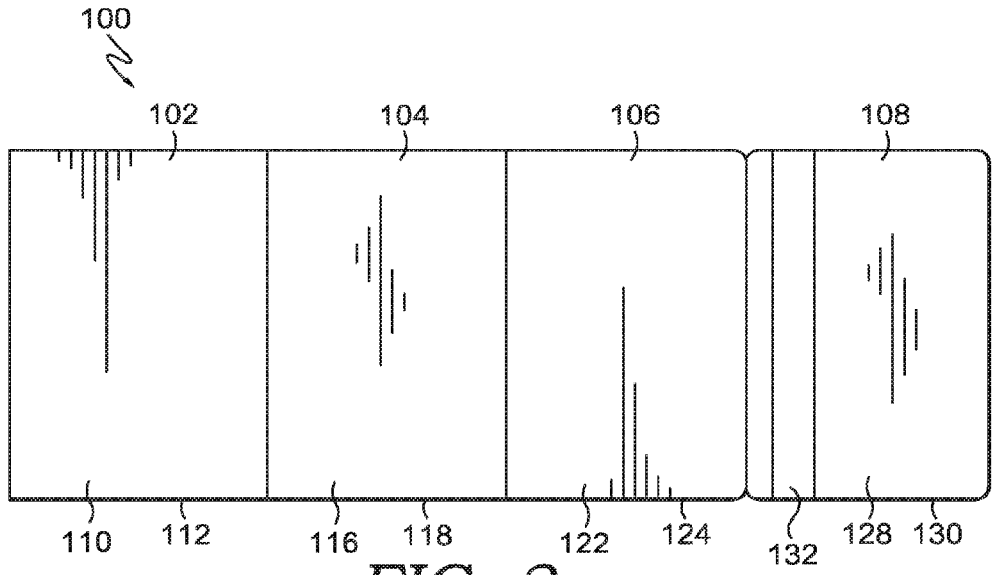
FIG. 2 depicts a front elevation view of the presenter depicted in FIG. 1 in an unfolded configuration, as it could be die cut from a single sheet of card stock.

By forming the presenter 100 from a single unitary piece of card stock, the die-cut card stock may be run through a printer prior to being folded to print a design, coloring, a pattern, sentiment or other indicia on one or both sides of the presenter. FIG. 2 depicts a front elevation view of the presenter 100 depicted in FIG. 1 with the first sides 110, 116, 122, 126 of each of the panels 102, 104, 106, 108 all facing up or in the same direction when the presenter 100 is lying flat and is in a flat, unfolded configuration, such as just after the die-cutting process. This arrangement and use of four panels allows the die cut blank to be passed through a single sided printer, yet still provide printing on all four surfaces of the presenter 100 when it is formed. This permits the presenter to be readily customizable, such as print on demand, for and by consumers. In this manner a consumer may design or customize (e.g. by adding a picture and/or sentiment) any or all of the four panels 102, 104, 106, or 108 and created a highly customized and unique combination greeting card and gift card presenter 100.

Referring now to FIG. 3, a front perspective view of the presenter 100 depicted in FIG. 1 is shown, with the presenter 100 in a formed and semi-closed configuration, in accordance with an aspect of the present invention. The panels 102, 104, 106, 108 are folded along the fold lines 114, 120, 126 to bring the panels 102, 104 and 106, 108 together into a presentation arrangement. The second side 112 of the cover panel 102 has been folded toward and coupled with the second side 118 of the first intermediary panel 104 to form a first half 134 of the presenter 100. The first half 134 of the presenter 100 includes the cover panel 102 and the first intermediary panel 104, which are joined together.

In FIG. 4, the second side 130 of the gift card panel 108 has been folded toward and coupled with the second side 124 of the second intermediary panel 106 to form a second half 136 of the presenter 100. The second half 136 of the presenter 100 includes the second intermediary panel 108 and the gift card panel 108, as well as the magnetic strip 132.

Referring now to FIG. 5, front and rear perspective views of two presenters 100 fully assembled and printed are shown. The front perspective view on the left and the rear perspective view on the right, depict the presenters 100 each in a substantially closed configuration. Each presenter 100 includes printed artwork 138 on a front cover panel 140 and the magnetic strip 132, along with a barcode 142 and some printed artwork 144, on the rear gift card panel 108.

Figure 6:
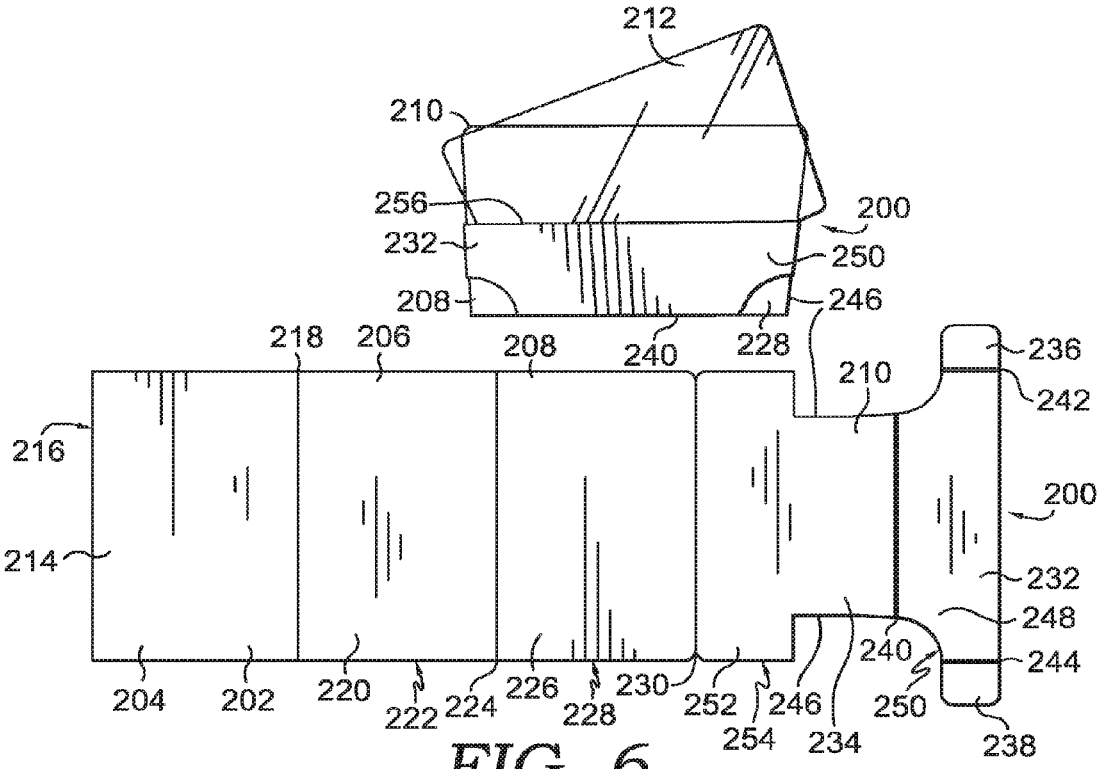
FIG. 6 depicts front elevation views of a second embodiment of the combination greeting card and gift card presenter in two configurations, namely, a first unfolded configuration of the presenter on the bottom, and a second folded version of the presenter on the top receiving a gift card, in accordance with an aspect of the present invention.

Referring now to FIG. 6, a side elevation view of a second embodiment of the combination greeting card and gift card presenter 200 is provided, showing a first unfolded configuration of the presenter 200 on the bottom and a second folded version of the presenter 200 on the top, in accordance with an aspect of the present invention. A die-cut card stock blank 202 used to form the presenter 200 is shown on the bottom. Similar to the presenter 100, the presenter 200 includes a cover panel 204, a first intermediary panel 206, and a second intermediary panel 208. However, instead of having the gift card formed as an integral part of the greeting card like in the presenter 100, in the presenter 200 the gift card panel 108 is replaced with a gift card holder panel 210, designed to releasably hold a separate gift card 212.

The cover panel 204 includes a first side 214 and a second side 216 and is coupled to the first intermediary panel 206 along a fold line 218. The first intermediary panel 206 includes a first side 220 and a second side 222 and is coupled to the second intermediary panel 208 along a second fold line 224. The second intermediary panel 208 includes a first side 226 and a second side 228 and is coupled to the gift card panel 210 along a third fold line 230. The gift card panel 210 includes a first fold panel 232 and a second fold panel 234. The first fold panel 232 includes first and second tabs 236, 238 for securing the first fold panels 232 to the second side 228 of the second intermediary panel 208.

The second fold panel 234 is separated from the first fold panel 232 by a fourth fold line 240. The first tab 236 is separated from the first fold panel 232 by a fifth fold line 242 and the second tab 238 is separated from the first fold panel 232 by a sixth fold line 244. Additionally, the gift card panel 210 includes cut-out sections 246 through which a portion of the gift card 212 can be viewed when the presenter 200 is in a folded configuration and receiving the gift card 212, as shown on top.

The first fold panel 232 comprises a first side 248 and a second side 250, and the second fold panel 234 comprises a first side 252 and a second side 254. In the folded configuration of the presenter 200, shown on the top of FIG. 6, the first sides 248, 252 of the first and second fold panels 232, 234 are folded together, and the second sides 228, 254 of the second intermediary panel 208 and the gift card panel 210 are folded and preferably secured (e.g., by adhesive) together. Similarly, in the folded configuration, the second side 216 of the cover panel 204 and the second side 222 of the first intermediary panel 206 are folded and preferably secured together.

Figure 7:
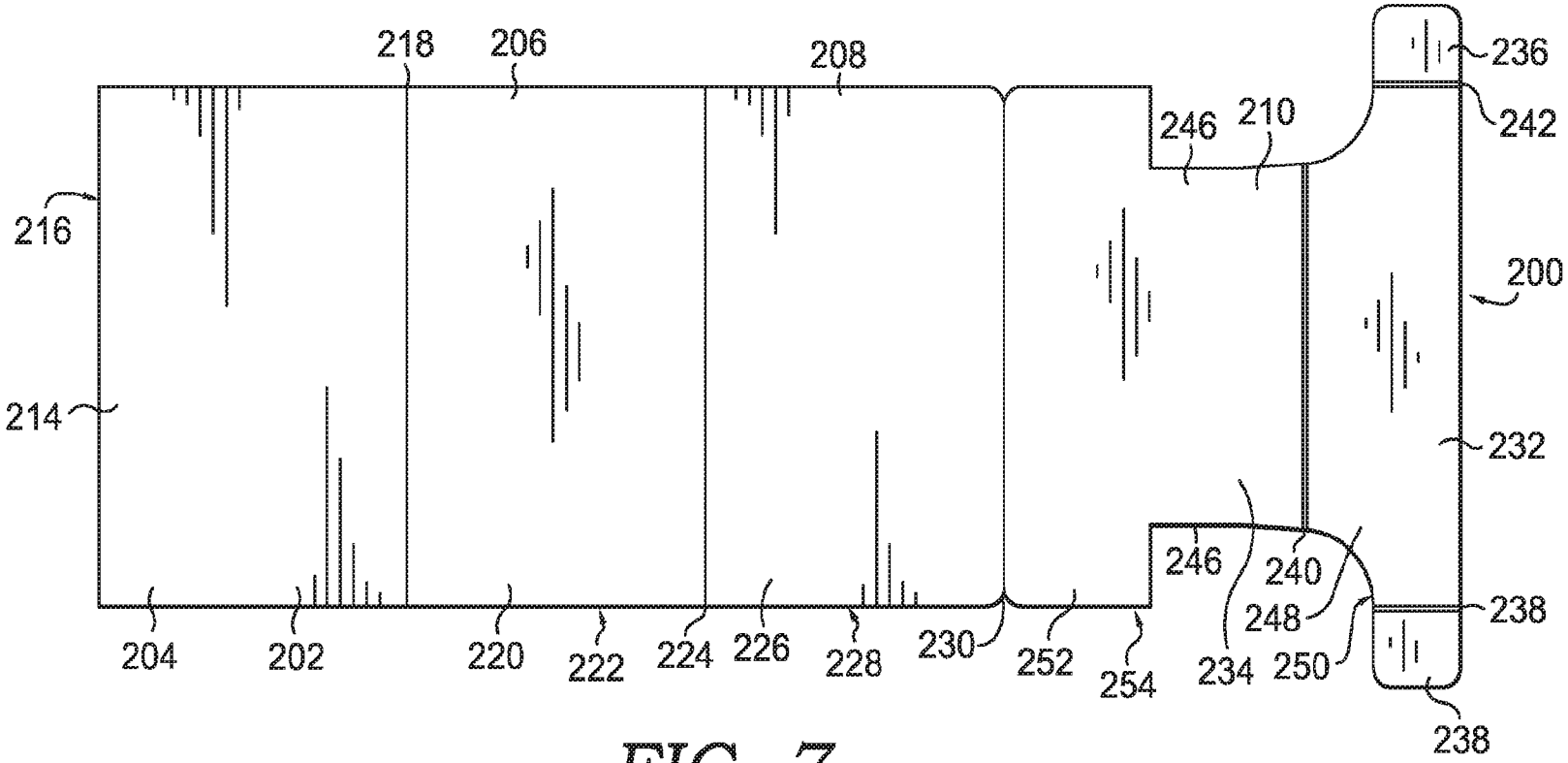
FIG. 7 depicts a front elevation view of the presenter depicted in FIG. 6 in an unfolded configuration, as it could be die cut from a single sheet of card stock.

When the presenter 200 is fully formed and is in a closed position, the first side 220 of the first intermediary panel 206 and the first side 226 of the second intermediary panel 208 are folded together and represent the interior of the greeting card portion. The tabs 236, 238 are secured to the second side 228 of the second intermediary panel 208 through the cut-out sections 246 to define a pocket and provide a slot 256 for receiving at least a portion of the greeting card 212. Alternatively, without the cut-out sections 246 or with smaller cut-out sections 246 the tabs 236, 238 can be secured to the first side 252 of the second fold panel 234 or placed behind the second fold panel 234 and secured to the second side 228 of the second intermediary panel 208 and/or the second side 254 of the second fold panel 234 of the gift card panel 210. In FIG. 7, a side elevation view of the presenter 200 depicted in FIG. 6 is shown, in accordance with an aspect of the present invention.

Figure 8:
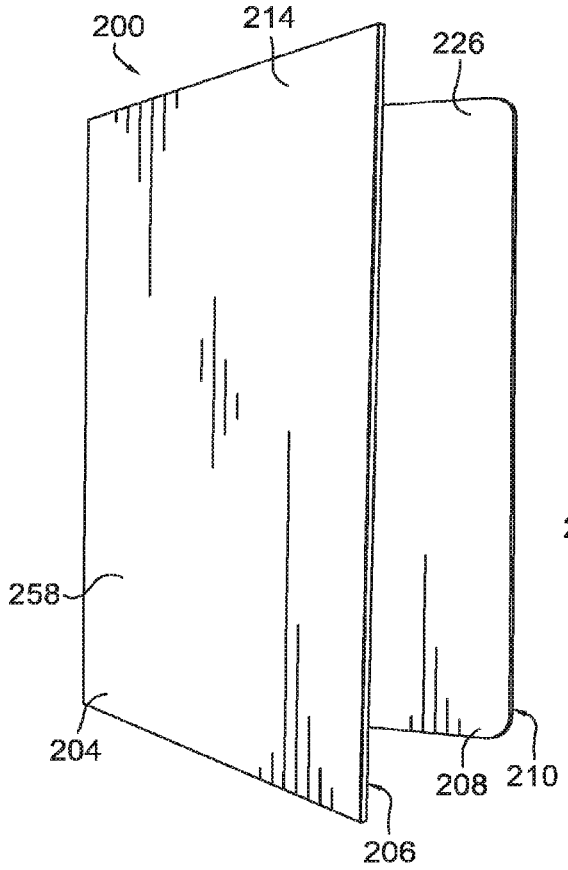
FIG. 8 depicts a front perspective view of the presenter depicted in FIG. 6, the presenter in a fully formed use arrangement and in a semi-closed configuration.
Figure 9:
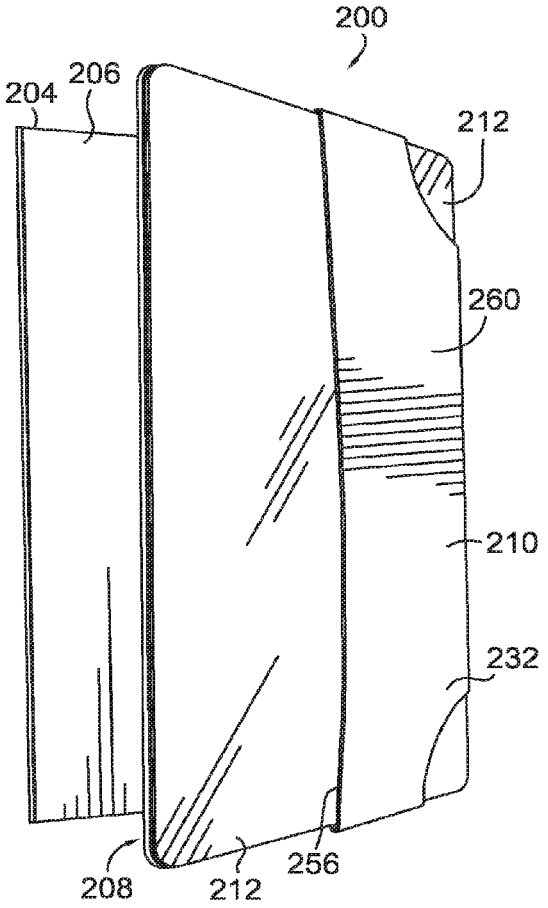
FIG. 9 depicts a rear perspective view of the presenter depicted in FIG. 8.

Referring now to FIG. 8, a front perspective view of the presenter 200 depicted in FIG. 6 is shown with the presenter 200 in a partially open configuration. The cover panel 204 and the first intermediary panel 206 are folded and secured together and coupled to form a first half 258 of the presenter 200. In FIG. 9 the presenter of FIG. 8 is illustrated from a rear perspective view to show that the second intermediary panel 208 and the folded gift card holder panel 212 are coupled together to form a second half 260 of the presenter 200 that includes the pocket 256 for receiving at least a portion of a greeting card 212. The presenter 200 may remain in this compact configuration and be opened and closed to allow presentation of the gift card 242 to a recipient.

Figure 10:
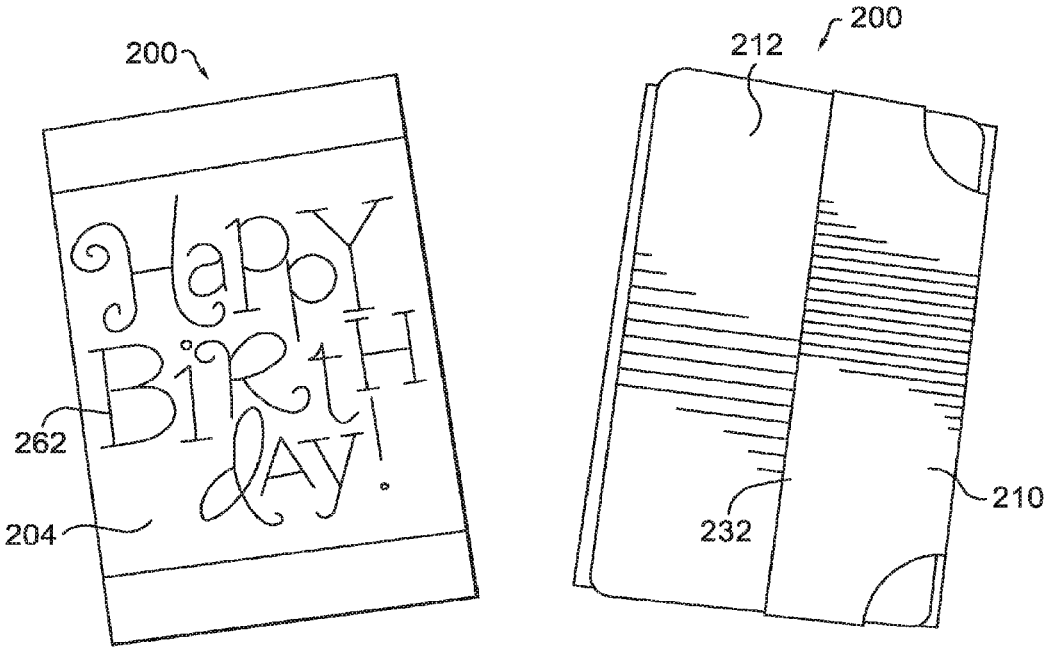
FIG. 10 depicts front and rear elevation views of the presenter of FIGS. 8-9 with indicia printed thereon and ready for use.

Referring now to FIG. 10, two elevation views of completely decorated presenters 200 depicted in FIGS. 8-9 are shown, including a front elevation view of the presenter 200 on the left and a rear elevation view of the presenter 200 on the right, both presenters in a substantially closed configuration, in accordance with an aspect of the present invention. In FIG. 10, the presenter 200 includes decorative art/sentiment 262 printed on the cover panel 204. Similar sentiment or other indicia 262 may be printed on the first fold panel 232 of the holding panel 210. As described herein, each of the panels shown in FIG. 6 may include artwork or design, or be left blank to receive writing from a gift giver, for decorative purposes. As with the first embodiment described above, the construction of the presenter 200 from a four panel blank allows for the blank to be run through a single sided printer before the blank is folded and the presenter 200 is formed. This allows for print on demand and custom printing applications without the need for a two sided printer or running the blank through a single sided printer twice (i.e., once on both sides).

Embodiments of the present invention have been described with the intent to be illustrative rather than restrictive. Alternative embodiments will become apparent to those skilled in the art that do not depart from the scope of the invention. A skilled artisan may develop alternative means of implementing the aforementioned improvements without departing from the scope of the present invention. It will be understood that certain features and subcombinations are of utility and may be employed without reference to other features and subcombinations and are contemplated as within the scope of the claims.

What is claimed is:

1. A combination greeting card and gift card presenter, the presenter comprising:

a cover panel; and a gift card holder coupled to the cover panel and comprising a first fold panel and a second fold panel, the first fold panel coupled to the second fold panel at a first fold line, wherein the first fold panel includes first and second folding tabs on opposite side edges of the first fold panel, wherein the first fold panel includes a first cutout portion from the opposite side edges adjacent the first and second folding tabs, wherein the second fold panel includes a second cutout portion adjacent to the first cutout portion, and wherein the first fold panel and the second fold panel may be folded together and the first and second folding tabs may be affixed to the second fold panel such that the first fold panel, the second fold panel, and the first and second folding tabs form a pocket for receiving at least a portion of a gift card.

2. The presenter of claim 1, wherein the cover panel and the second fold panel are coupled along a second fold line separate from the first fold line.

3. The presenter of claim 1, wherein the presenter is formed from die-cut card stock.

4. The presenter of claim 1, wherein when the first fold panel and the second fold panel are folded together and coupled with the first and second folding tabs, the first and second cutout portions form two corner openings in the pocket through which corners of the gift card are viewable when the gift card is received in the pocket.

5. A combination greeting card and gift card presenter, the presenter comprising:

a cover panel; and a gift card holder coupled to the cover panel, the gift card holder comprising a first fold panel and a second fold panel separated by a first fold line, the first fold panel comprising a pair of folding tabs on opposite side edges of the first fold panel, wherein the first fold panel includes a first cutout portion on the opposite side edges adjacent the first and second folding tabs, wherein the second fold panel includes a second cutout portion adjacent the first cutout portion, and wherein the first and second fold panels and the pair of folding tabs are folded together to form a pocket for receiving a gift card.

6. The presenter of claim 5, wherein the presenter is made from die-cut card stock.

7. The presenter of claim 5, further comprising one or more intermediary panels coupled between the cover panel and the gift card holder.

8. The presenter of claim 7, wherein the one or more intermediary panels comprises a first intermediary panel and a second intermediary panel coupled between the cover panel and the gift card holder.

9. The presenter of claim 8, wherein the cover panel, the first intermediary panel, and the second intermediary panel are a same size.

10. The presenter of claim 5, wherein when the first fold panel and the second fold panel are folded together and coupled with the pair of folding tabs, the first and second cutout portions form two corner openings in the pocket through which corners of the gift card are viewable when the gift card is positioned in the pocket.

11. The presenter of claim 10, wherein the first and second cutout portions each comprise at least one of a curved edge portion and a perpendicular edge portion.

12. The presenter of claim 10, wherein the pair of folding tabs are each coupled to the second fold panel with an adhesive.

13. A combination greeting card and gift card presenter, the presenter comprising:

a cover panel; and a gift card holder coupled to the cover panel, the gift card holder comprising a first fold panel and a second fold panel, the first fold panel coupled to the second fold panel at a first fold line, the second fold panel coupled to the cover panel or an intermediary panel therebetween at a second fold line, wherein the first fold panel includes first and second folding tabs on opposite side edges of the first fold panel, wherein the first fold panel includes a first cutout portion on the opposite side edges adjacent the first and second folding tabs, wherein the second fold panel includes a second cutout portion adjacent the first cutout portion, and wherein the first fold panel and the second fold panel may be folded together and the first and second folding tabs may be affixed to the second fold panel such that the first fold panel, the second fold panel, and the first and second folding tabs form a pocket for receiving at least a portion of a gift card, the first and second cutout portions forming openings in corners of the pocket for revealing the gift card.

14. The presenter of claim 13, wherein the presenter is made from die-cut card stock.

15. The presenter of claim 14, wherein the die-cut card stock includes a printed design on at least one side of the die-cut card stock.

16. The presenter of claim 13, further comprising a first intermediary panel and a second intermediary panel coupled between the cover panel and the second fold panel.

17. The presenter of claim 13, wherein the first and second folding tabs are secured to the second fold panel with an adhesive.

* * * * *